US005527253A

United States Patent [19]

Wilkinson et al.

[11] Patent Number: 5,527,253

[45] **Date of Patent: *Jun. 18, 1996**

[54] COMBINATION TWISTER AND STEPPER EXERCISE DEVICE

[75] Inventors: William T. Wilkinson, P.O. Box 73, Salem, N.J. 08079; John J. Nelson, Levitown, Pa.

[73] Assignee: William T. Wilkinson, Salem, N.J.

[ * ] Notice: The term of this patent shall not extend beyond the expiration date of Pat. No. 5,284,461.

[21] Appl. No.: 376,243

[22] Filed: Jan. 23, 1995

Related U.S. Application Data

[63] Continuation-in-part of Ser. No. 151,957, Nov. 15, 1993, which is a continuation-in-part of Ser. No. 56,930, May 5, 1993, Pat. No. 5,284,461.

[51] Int. Cl.[6] ..... B63B 22/14

[52] U.S. Cl. ..... 482/147; 482/53; 482/52; 482/146

[58] Field of Search ..... 482/51, 53, 52, 482/147, 79, 51, 146, 147, 70, 71

[56] References Cited

U.S. PATENT DOCUMENTS

| | | | |
|---|---|---|---|
| 3,834,693 | 9/1974 | Poppenberger . | |
| 5,078,389 | 1/1992 | Chen . | |
| 5,282,776 | 2/1994 | Dalebout | 482/52 |
| 5,284,461 | 2/1994 | Wilkinson | 482/53 |
| 5,344,376 | 9/1994 | Bostic et al. | 482/147 |

FOREIGN PATENT DOCUMENTS

| | | |
|---|---|---|
| 0466458A2 | 7/1991 | European Pat. Off. . |

*Primary Examiner*—Jerome Donnelly
*Attorney, Agent, or Firm*—Connolly & Hutz

[57] ABSTRACT

A combination twister and stepper device includes a stepper unit and a twister unit in combination with a common frame. The stepper unit has a pair of side by side steps, each of which is biased upwardly. The twister includes a turntable or disk on a pivotal mount. The stepper and twister are secured to a frame which includes a pair of pivotal poles. The stepper and twister may be used simultaneously while also using the poles or the stepper and twister may be selectively inactivated so that only one of the units could be used.

3 Claims, 3 Drawing Sheets

COMBINATION TWISTER AND STEPPER EXERCISE DEVICE

CROSS-REFERENCE TO RELATED APPLICATION

This application is a continuation-in-part of application Ser. No. 151,957 filed Nov. 15, 1993, which in turn is a continuation-in-part of application Ser. No. 56,930, filed May 5, 1993, now U.S. Pat. No. 5,284,461.

BACKGROUND OF THE INVENTION various types of exercise devices exist to develop different parts of the body. One particularly advantageous form of known exercise device is known as a stepper. Such steppers generally include a pair of side by side steps biased upwardly so that the user must overcome the biasing force to move each step downwardly. Frequently such steppers are provided on a frame having pivoted poles to provide an arm exercise device which could be used simultaneously with the stepping action.

Another form of known exercise device is a twister type device which utilizes a pivoted disk in the form of a turntable. The user would step on the disk or turntable and twist at the hips while moving a pair of pivoted poles to, for example, overcome a resistance force at the poles. This form of exercise device develops the arms, waist, hips and thighs.

It would be desirable if some combination exercise device could be provided which incorporates the benefits of both the stepper and twister in addition to the arm exercise provided by the pivoted poles.

SUMMARY OF THE INVENTION

An object of this invention is to provide such a combination device which meets the above needs.

A further object of this invention is to provide such a device wherein the stepper and twister could be used simultaneously while also performing an arm exercise with poles or wherein either the stepper or twister could be inactivated so that only one of the units would be used while exercising with the poles.

In accordance with this invention a combination stepper and twister is provided wherein the stepper includes a pair of side by side steps each of which is biased upwardly. The twister is a disk pivotally mounted on a frame having a pair of pivotally mounted resistance poles so that the user could twist at the hips while performing an upper body exercise through use of the poles. Both the stepper and twister are mounted to the frame having the poles. Frames are provided for selectively inactivating the stepper or the twister so that the user has the option of simultaneously exercising on both the stepper and the twister while exercising with the poles or exercising with either the stepper or twister while exercising with the poles.

The invention may be practiced by mounting the stepper directly on the twister which in turn is mounted to the frame. Alternatively, the twister could be mounted directly on the stepper which is mounted to the frame. In a further alternative, each of the stepper and twister could be mounted directly on the frame adjacent each other.

THE DRAWINGS

DETAILED DESCRIPTION

The present invention is based on the concept of combining two different forms of exercise in the same machine including a form of exercise which includes pivoted poles for providing an arm exercise. As later described the combined unit can combine a conventional twist device with a conventional stepper. Use is made of the fact that some forms of twist devices are provided with pivoted arms. Reference is made, for example, to the Twist 'N Ski device which is a trademark of NordicTrack. In the Twist 'N Ski device a disk or rotatably mounted on a base which in turn is mounted to a frame having a pair of pivotable arms. Any suitable type stepper could be used such as the Doubler Burner Exercise Machine which includes a pair of steps mounted on hydraulic cylinders and also includes pivoted poles.

In known stepper and twister devices the pivotally mounted poles have adjustable resistance in order to vary the upper body exercise through use of the poles. If desired the variable resistance could also be achieved in the manners described in the parent applications, the details of which are incorporated herein by reference thereto.

Figure 3:
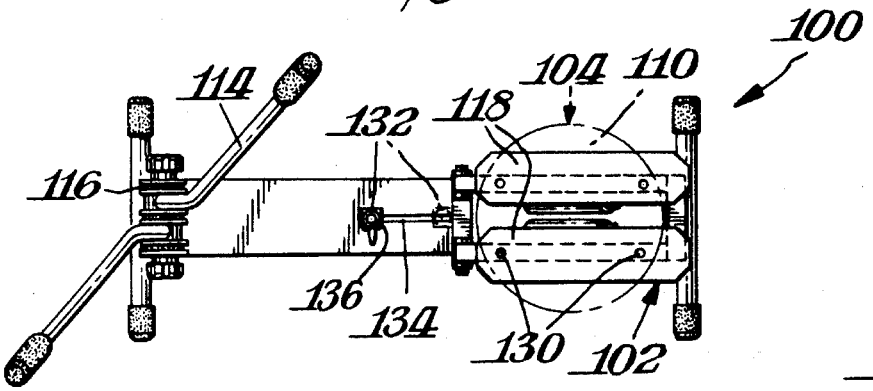
FIG. 3 is a top plan view of the device shown in FIGS. 1–2.
Figure 1:
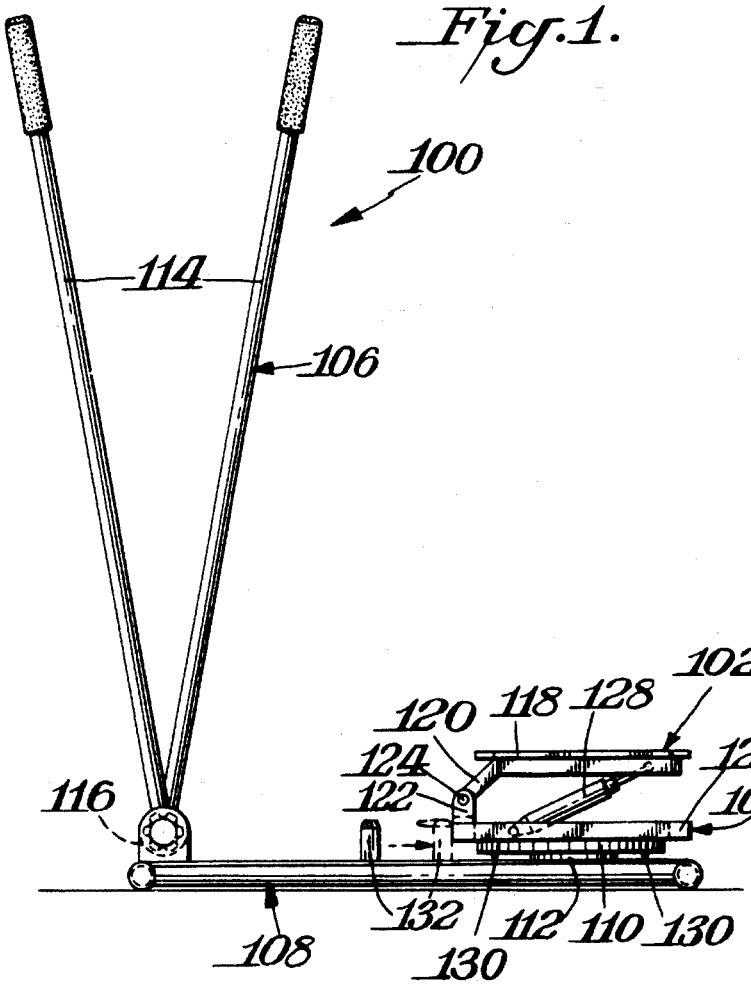
FIG. 1 is a side elevational view of a combination stepper and twister device in accordance with one embodiment of this invention.
Figure 2:
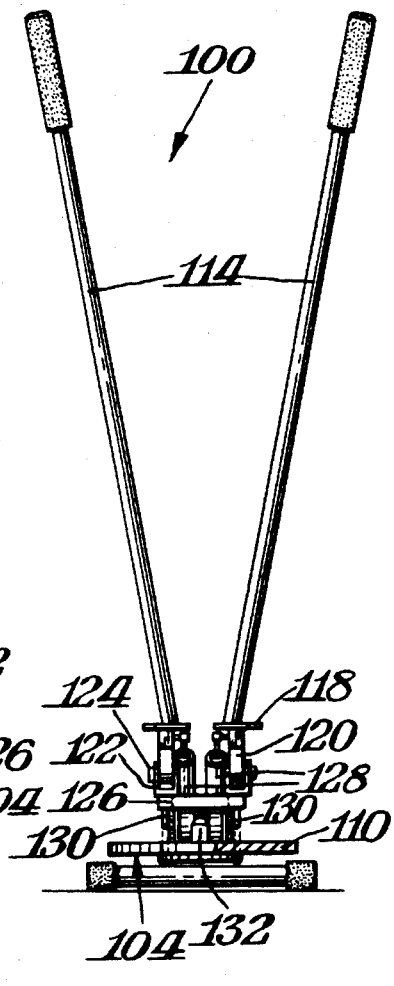
FIG. 2 is an end elevational view partly in section of the device shown in FIG. 1.

FIGS. 1–3 illustrate one form of this invention wherein the combination stepper and twister device 100 is shown in the form of a stepper 102 which is mounted directly on a twister 104 with the pivoted arms 106 being disposed at the end of the frame 108 for the twister.

In this embodiment of the invention twister 104 is formed similar to a turntable having an upper disk 110 disposed on a pivot member 112 generally at one end of frame 108 with the arm assembly 106 mounted to the opposite end of frame 108. Arm assembly 106 includes a pair of arms 114,114 each of which is pivotally mounted to an adjustable resistance unit 116. The arms 114 may be of bent construction as shown in FIG. 3 to allow the user's legs to clear as the user rotates from side to side.

Stepper 102 includes a pair of side by side steps 118,118 each of which is pivotally mounted at one end thereof. As illustrated herein the steps 118,118 are mounted on brackets 120 with the lower end of the bracket pivotally connected to extension 122 by pivot pins 124 on base 126. A piston/cylinder assembly such as a hydraulic cylinder 128 is pivotally secured to one end at base 126 and at its other end to the free end of its respective step 118. Thus, the hydraulic cylinder 128 biases or urges each step in an upward condition and this biasing force must be overcome by the user stepping down on the respective steps.

The stepper unit 102 could be mounted to frame 108 in any suitable manner. In the embodiment of FIGS. 1–3 this mounting is accomplished by providing a plurality of pins 130 which fit through corresponding holes in disk 110. In this manner, the disk 110 provides support for the stepper unit 102. Accordingly, in the embodiment shown in FIGS. 1–3 it is possible for a user to achieve the benefits of a stepper by stepping up and down on steps 118 and at the same time achieving the benefits of a twister unit by twisting while performing the stepper exercise. The twisting in turn results in disk 110 pivoting on pivot member 112. Simultaneously with this joint exercise the user would also be pulling and pushing on poles or arms 114 to provide a complete workout.

If it is desired to inactivate the stepper 102 all that need be done is to lift the stepper 102 upwardly so that the pins 130 are removed from the holes in disk 110. Thus the entire stepper unit is removed and the user would stand directly on disk 110 to utilize the twister 104 and the poles 106.

Means are also provided in device 100 for selectively inactivating twister 104. Any suitable means could be used. The illustrated form includes a sliding block member 132 mounted in a slot 134 in frame 108. Lock member 132 has a flat side 136 which would abut against base 126 when lock member 132 is moved from the position shown in solid lines to the position shown in phantom. Block member 132 could be held in either of these positions by any suitable fastener. When in the position shown in phantom the flat face 136 abuts against a corresponding flat surface of base 126 which prevents any rotation of base 126 and thus also inactivates disk 110 to prevent disk 110 from rotating. Thus, in the position shown in phantom only stepper 102 could be used with poles 106.

Figure 5:
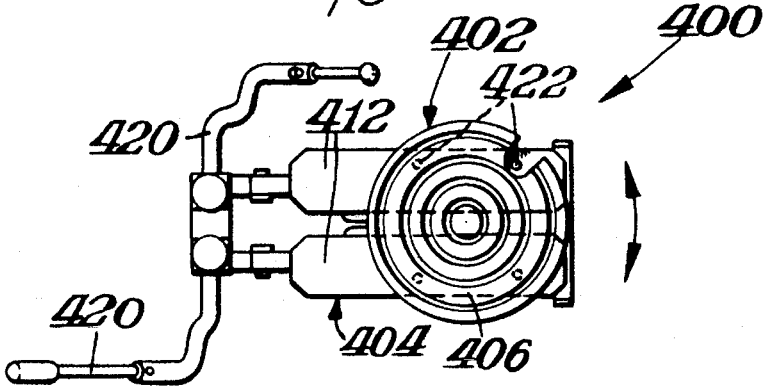
FIG. 5 is a top plan view of the device shown in FIG. 4.
Figure 4:
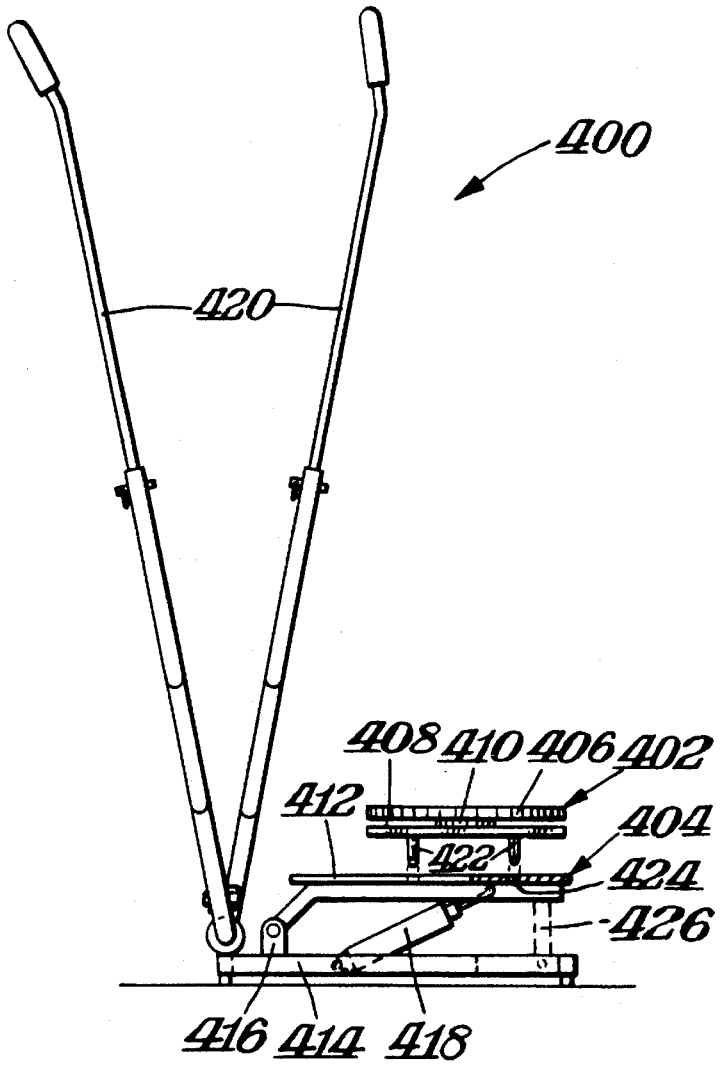
FIG. 4 is a side elevational exploded view partly in section of a modified form of device in accordance with this invention.

FIGS. 4–5 illustrate a variation of this invention wherein a device 400 combines a twister 402 with a stepper 404. In the illustrated form twister 402 includes a disk 406 mounted on a stationary disk 408 by means of a pivot member 410.

Stepper 404 includes a pair of steps 412. As shown therein stepper 404 would be of generally the same construction as stepper 102. As illustrated, steps 412 are pivotally mounted to frame 414 at brackets 416 with the free end of the step connected to a hydraulic cylinder 418. The frame 416 includes a pair of pivoted poles 420. In the embodiment illustrated in FIGS. 4–5 the base disk 408 of twist device 402 includes a plurality of downwardly extending pins 422 which are positioned for insertion into a corresponding number of holes 424 in the steps 412 of stepper 404. This manner of directly detachably mounting the twist disk unit 402 to the stepper unit 404 provides the user with a number of alternative exercises. Thus, for example, the twist disk unit 402 could be inactivated by being detached and the stepper 404 and poles for arms 420 could be utilized for an exercise program.

Alternatively, the twist disk unit 402 could be mounted on the steps 412 and the steps could be locked in any suitable manner in a horizontal position so that the side by side coplanar steps 412 act as a support for the twist unit 402 and the user could exercise with the twist unit and if desired with the arms or poles 420. FIG. 4 illustrates detachable lock posts 426 insertable under each step 412 to inactivate stepper 404.

It is to be understood that the invention may be practiced in other manners such as by mounting the twister unit in front of or behind or along side and adjacent to the stepper rather than directly above or below the stepper. Where the disk unit is mounted in front of or behind or along side the stepper, it is also possible to have the mount as a permanent mount rather than a detachable mounting although a detachable mounting is preferred.

It is to be understood that the specific forms of steppers and twisters are merely for exemplary purposes. Thus, for example a twister may be used which either freely rotates or rotates against resistance. Additionally, steppers could be used having other forms of urging or biasing means such as springs rather than hydraulic cylinders. Steppers of the type described in U.S. Pat. No. 4,659,075, for example, may also be used such as steps interconnected by a suspended cord so that one step is elevated when the user shifts weight to the other step to lower that other step. Pivoted steps could also be utilized which are pivoted at the center instead of an end.

It is within the broad concept of this invention to utilize the stepper itself as both a stepper and the twist mechanism. This could be done, for example, by pivotally mounting the entire stepper unit on the base or frame of the device and then locking the steps when they are horizontally coplanar with each other to prevent up and down movement of the steps. The steps themselves would then be used as the surface upon which the user stands while doing a twisting motion which is possible by virtue of the stepper unit being pivotally mounted.

Figure 7:
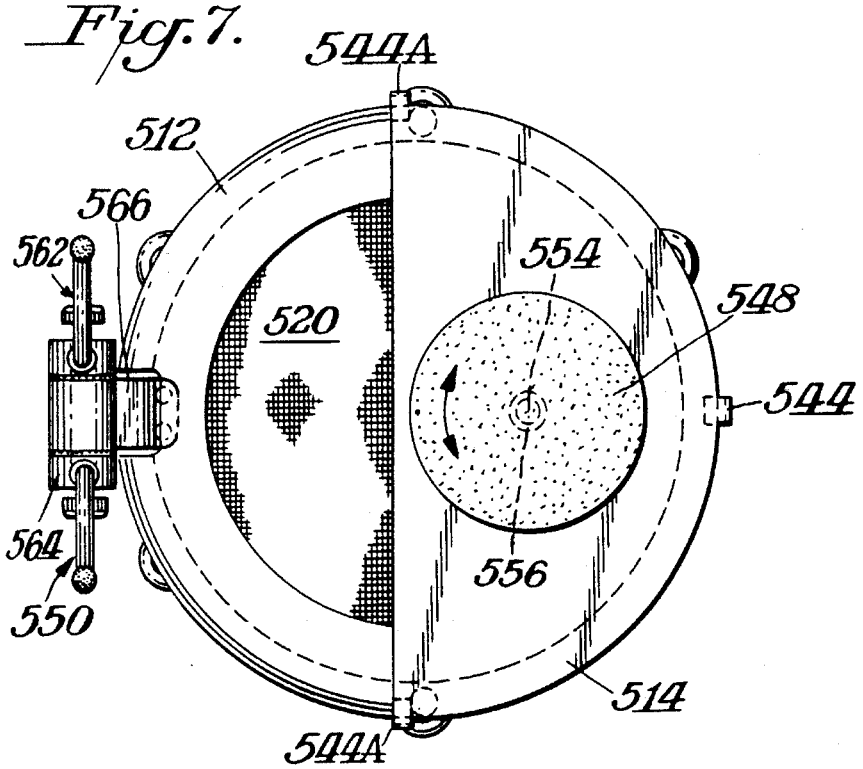
FIG. 7 is a top plan view of the form of the invention shown in FIG. 6 and FIG. 8.
Figure 6:
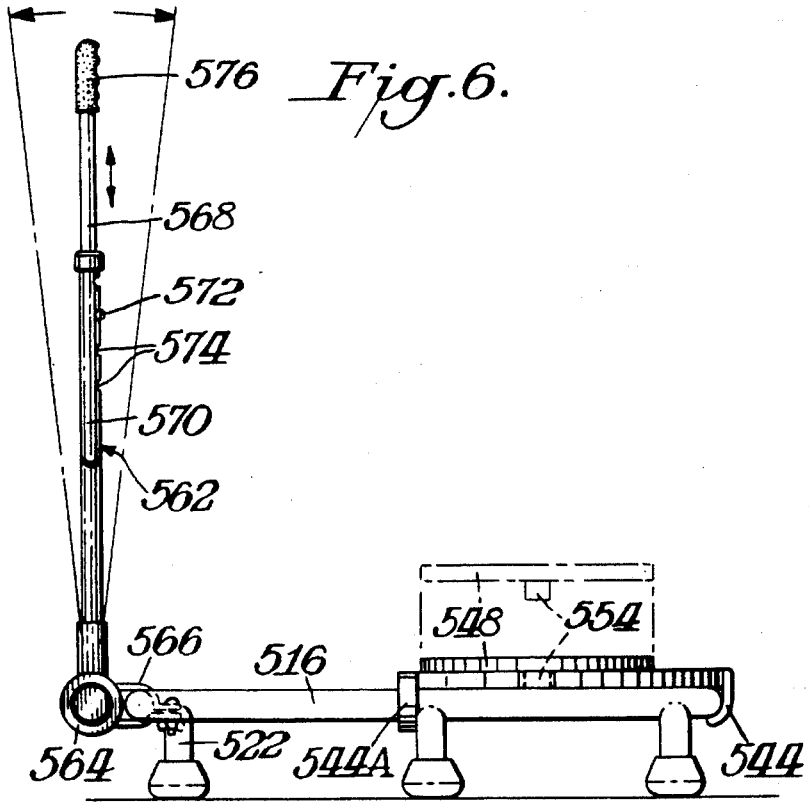
FIG. 6 is a side elevational view of a modified form of this invention.
Figure 8:
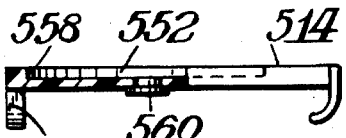
FIG. 8 is a side elevational view partly in section of a modified form of step/twister usable with this invention.

FIGS. 6–8 correspond to the same figures in parent application Ser. No. 151,957 filed Nov. 15, 1993, the details of which are incorporated herein by reference thereto. In general, those figures show a practice of the invention wherein the twist device is mounted on a step which in turn is mounted on a trampoline. As illustrated therein the step 514 is detachably mounted on trampoline 512 by being secured to the frame 516 through the use of end spring clips 544A and central spring clip 544. End spring clips 544A are disposed outwardly of asset of the lets 522.

The twister 548 is mounted on step 514 in a pivotal manner by means of shaft 554 to which disk 552 is secured. Shaft 554 is disposed in bearing opening 556.

The device further includes a pole assembly 550 which comprises poles 562 pivotally mounted to the frame 516 with a resistance mechanism 564 disposed at the pivotal mounting. The pole assembly 50 is detachably mounted to frame 516 by means of bracket 556. The pole assembly includes a pair of poles each of which has an inner pole 568 telescopically arranged in an outer pole 570 with its height being controlled by a spring pin 572 engaged in poles 574. The poles terminate in handles 576.

FIG. 8 illustrates a variation of the invention wherein the step 516 has a recess 558 for receiving the twister disk 552 with a lock 560 provided to selectively prevent rotation of disk 552.

What is claimed is:

1. A combination twist exercise and stepper exercise device comprising a support, a stepper unit including a pair of side by side steps a twist exercise unit and resistance means reacting against said steps to urge said steps upwardly whereby a user must overcome the force of said resistance means to sequentially move said steps downwardly in a stepping exercise with said steps disposed in a longitudinal direction, a handle located at each side of said steps for being grasped by the user during a stepping exercise, each of said handles being mounted to said support, said twist exercise unit mounted to said support, said twist exercise unit having a rotatably mounted twist surface on which a user may stand and twist, said twist unit having a lateral direction perpendicular to said longitudinal direction, said steps of said stepper unit being operatively mounted to and mounted at least partially within the lateral confines of said twist exercise unit when said twist exercise unit is in its operative condition, and said twist exercise unit and said handles being mounted to a common structural assembly.

2. The device of claim 1 wherein said twist exercise unit is separate and distinct from said stepper unit.

3. The device of claim 1 including locking members for locking said steps together when said steps are horizontal to inactivate said steps to prevent the performing of a stepping exercise when it is desired to perform a twist exercise.

* * * * *